US007857967B2

(12) United States Patent
Lee

(10) Patent No.: US 7,857,967 B2
(45) Date of Patent: Dec. 28, 2010

(54) SLUDGE TREATMENT SYSTEM FOR DAM

(76) Inventor: Wan Young Lee, 103-202 Gwanak Hyeondae Apt., 1000 Bongcheon 3-dong, Gwanak-gu, Seoul (KR) 151-755

( * ) Notice: Subject to any disclaimer, the term of this patent is extended or adjusted under 35 U.S.C. 154(b) by 259 days.

(21) Appl. No.: 11/991,747

(22) PCT Filed: Sep. 5, 2006

(86) PCT No.: PCT/KR2006/003522

§ 371 (c)(1),
(2), (4) Date: May 20, 2008

(87) PCT Pub. No.: WO2007/032616

PCT Pub. Date: Mar. 22, 2007

(65) Prior Publication Data

US 2009/0255865 A1 Oct. 15, 2009

(30) Foreign Application Priority Data

Sep. 12, 2005 (KR) ..... 10-2005-0084795

(51) Int. Cl.
*E02B 8/00* (2006.01)

(52) U.S. Cl. ..... 210/170.04; 210/170.09; 405/74; 405/107; 137/140; 137/143; 37/318

(58) Field of Classification Search ..... 210/170.04, 210/170.09, 532.1; 405/74, 107; 37/317, 37/318; 137/140, 143
See application file for complete search history.

(56) References Cited

U.S. PATENT DOCUMENTS

| | | | | |
|---|---|---|---|---|
| 775,255 | A | 11/1904 | Sewall et al. | |
| 1,907,691 | A * | 5/1933 | Wait | 210/170.1 |
| 4,052,800 | A * | 10/1977 | Fuhrboter et al. | 37/317 |
| 4,264,105 | A * | 4/1981 | Thompson | 405/74 |
| 4,343,696 | A * | 8/1982 | Hung | 210/170.09 |
| 4,807,373 | A * | 2/1989 | Sloan et al. | 210/170.04 |
| 2005/0161380 | A1 * | 7/2005 | Crawford | 210/170 |

FOREIGN PATENT DOCUMENTS

| | | | |
|---|---|---|---|
| JP | 1-315514 | A | 12/1989 |
| JP | 1 236 832 | A1 | 9/2002 |
| KR | 1993-0009106 | * | 5/1993 |

* cited by examiner

*Primary Examiner*—Christopher Upton
(74) *Attorney, Agent, or Firm*—Christopher Paul Mitchell

(57) ABSTRACT

The sludge treatment system is comprised of a dam passage penetrated through a dam (D); an induction pipe (11) for discharging a sediment retained by the dam (D) and having an inlet (11*a*) toward the floor of the dam (D) and an outlet connected to an inner end of the dam passage; an induction force action pipe (13) connected to an outer end of the dam passage and extended in a height for utilizing an atmospheric pressure as an induction force of the sediment; a U shape air control pipe (14) connected to the induction force action pipe (13), and preventing for an air from coming into the induction force action pipe (13); a drain pipe (15) connected to the air control pipe (14) for discharging the sediment; and an air vent pipe (16) connected to a horizontal flat portion of the air control pipe (14) for dissipating the induction action of both the air control pipe (14) and the drain pipe (15).

9 Claims, 11 Drawing Sheets

[Fig. 1]
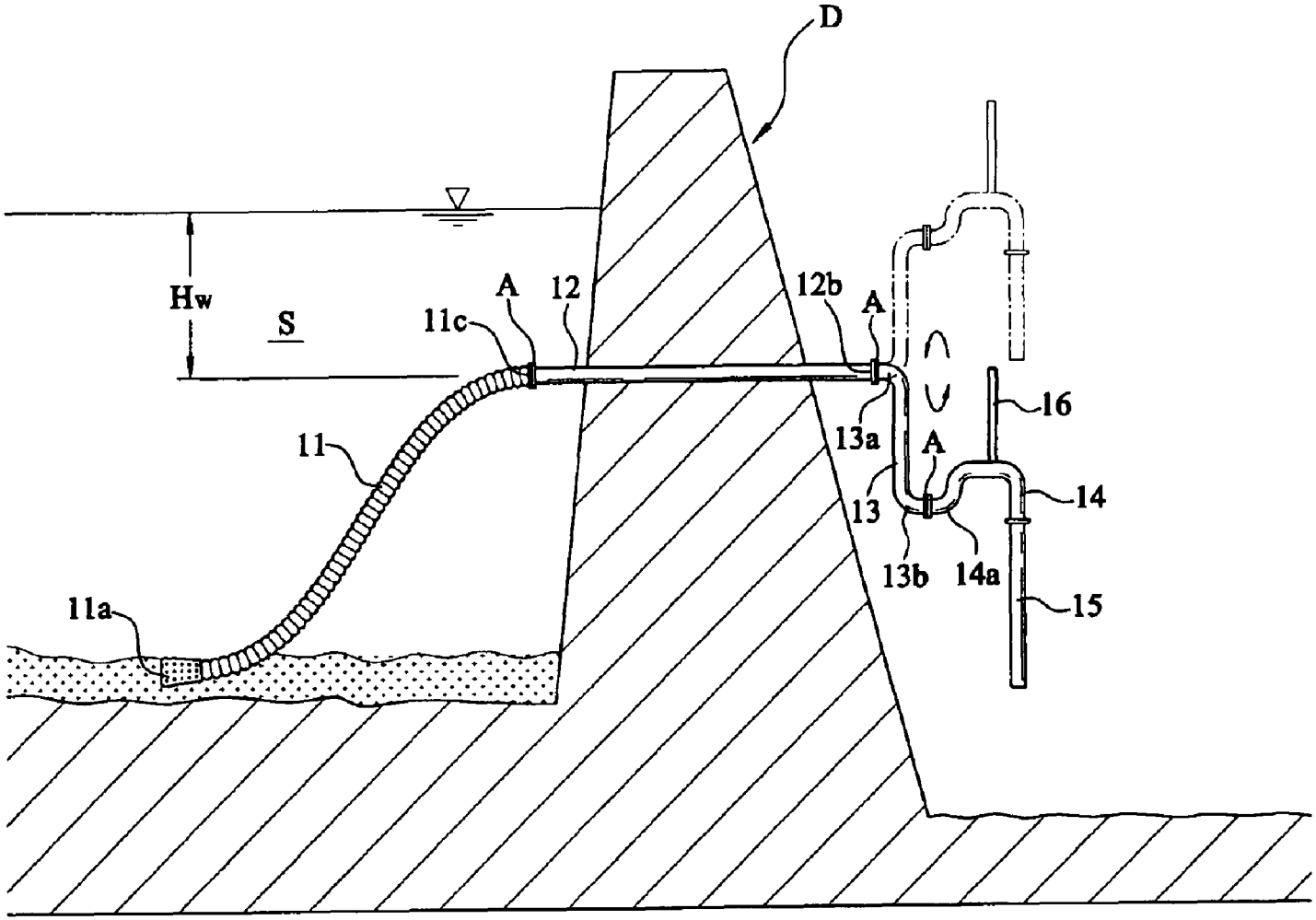

[Fig. 2]
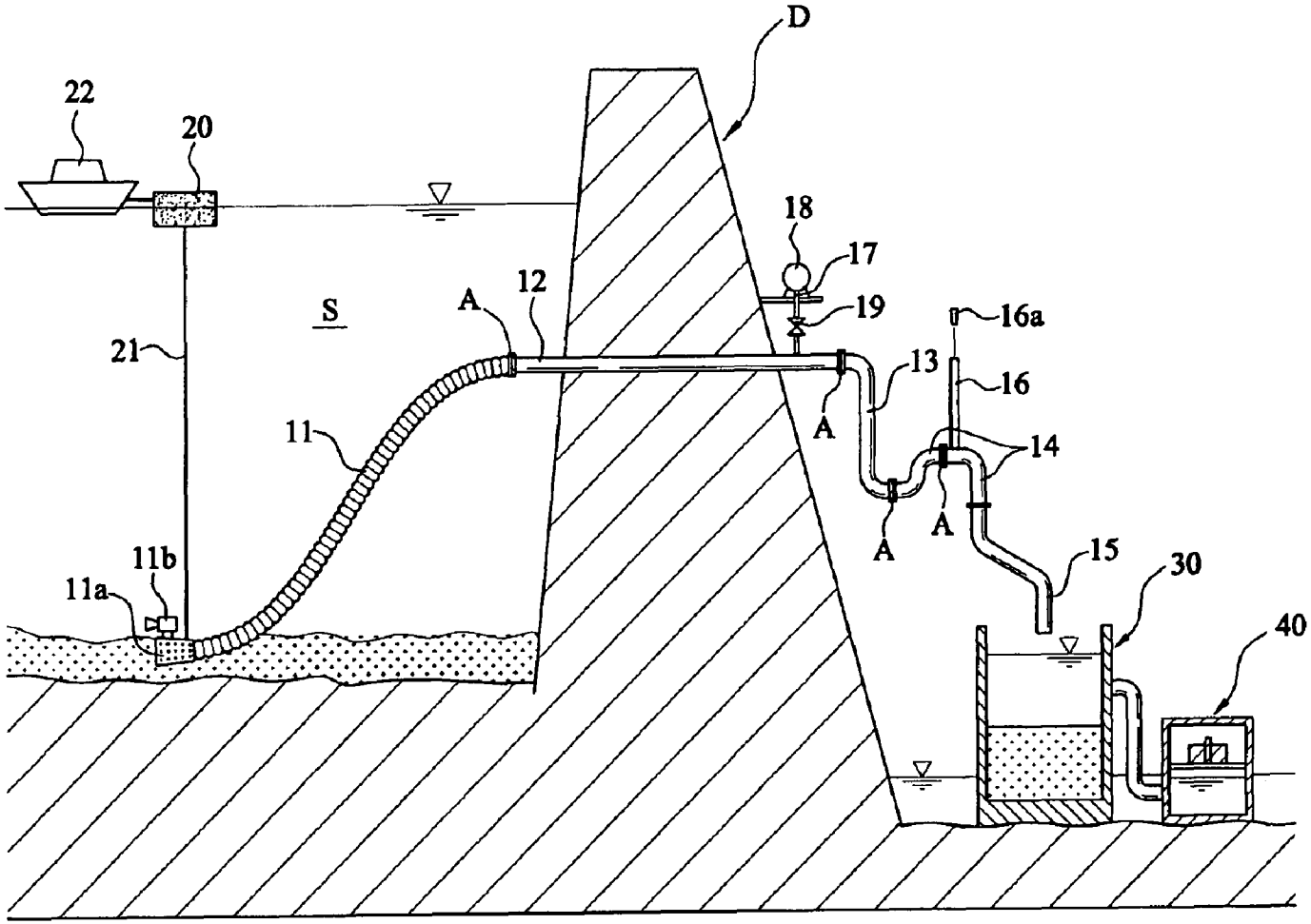

[Fig. 3]
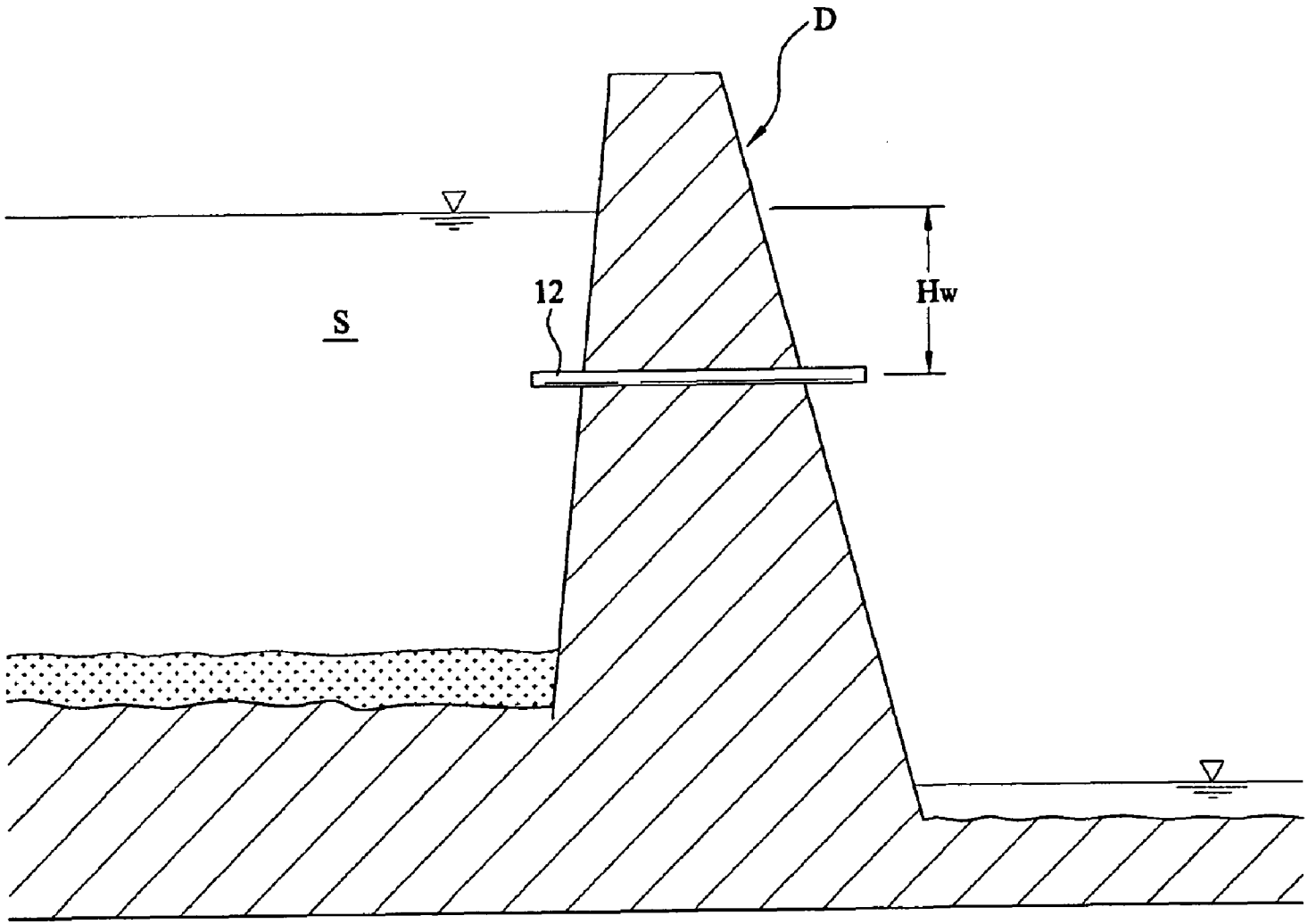

[Fig. 4]
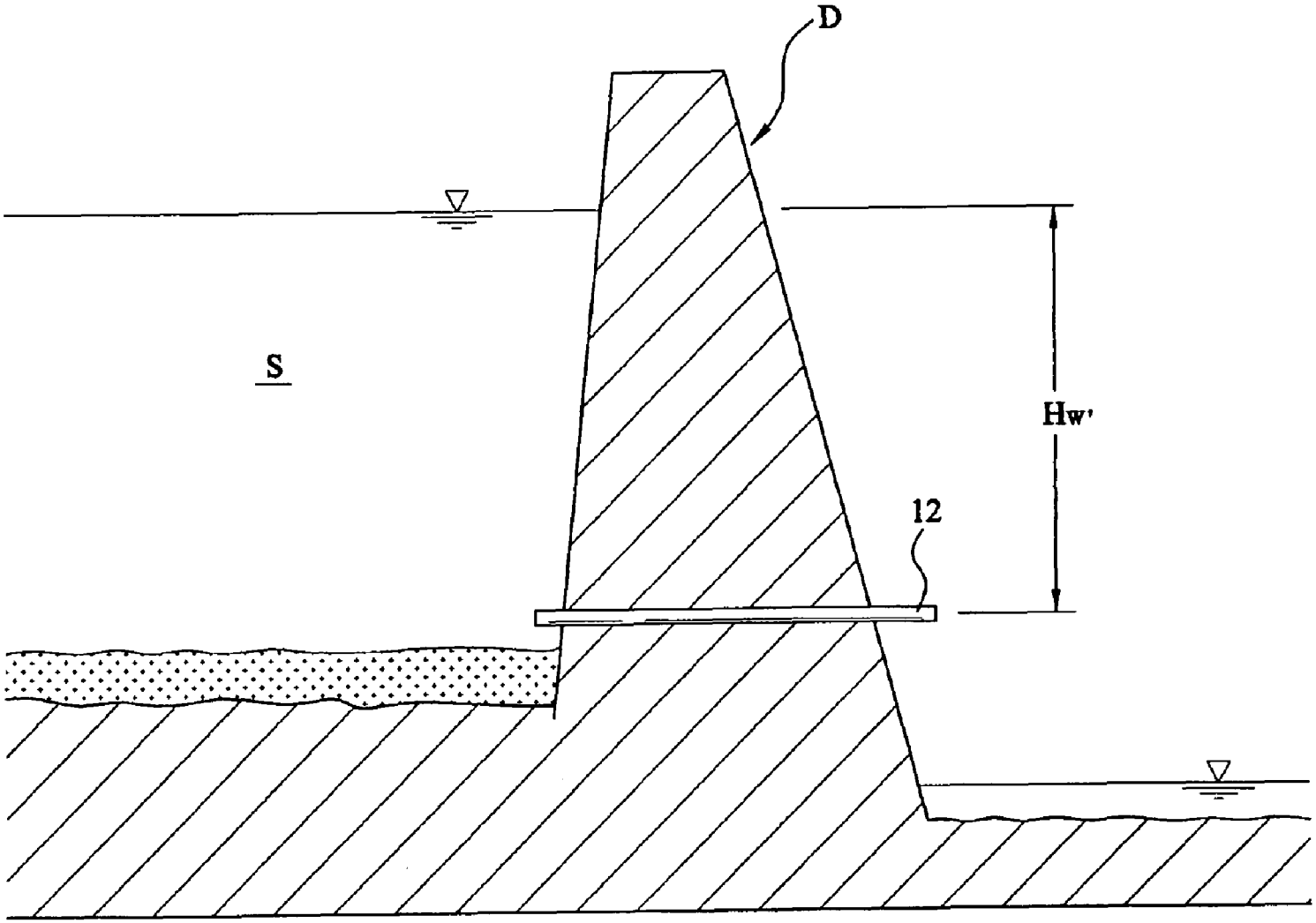

[Fig. 5]
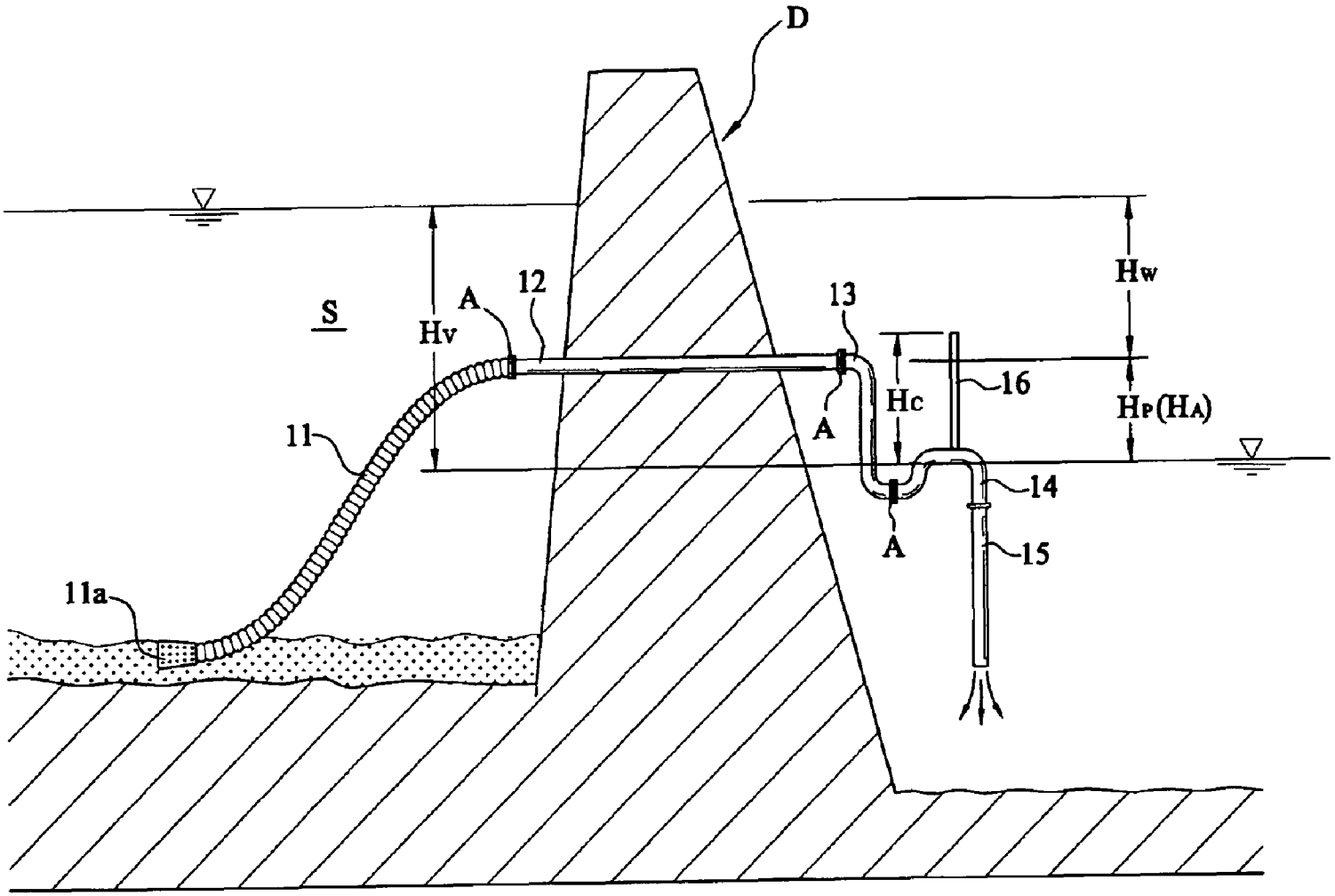

[Fig. 6]
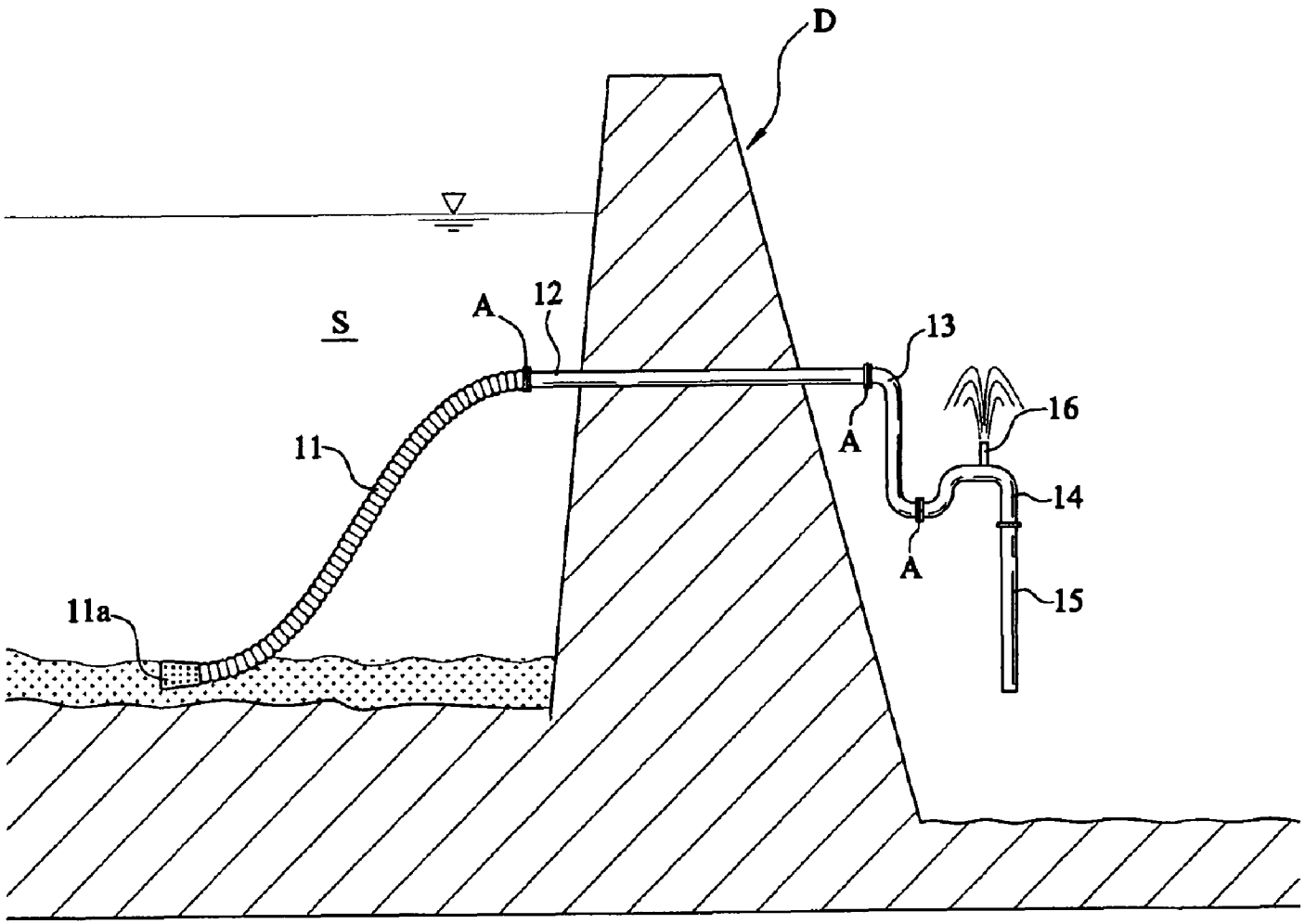

[Fig. 7]
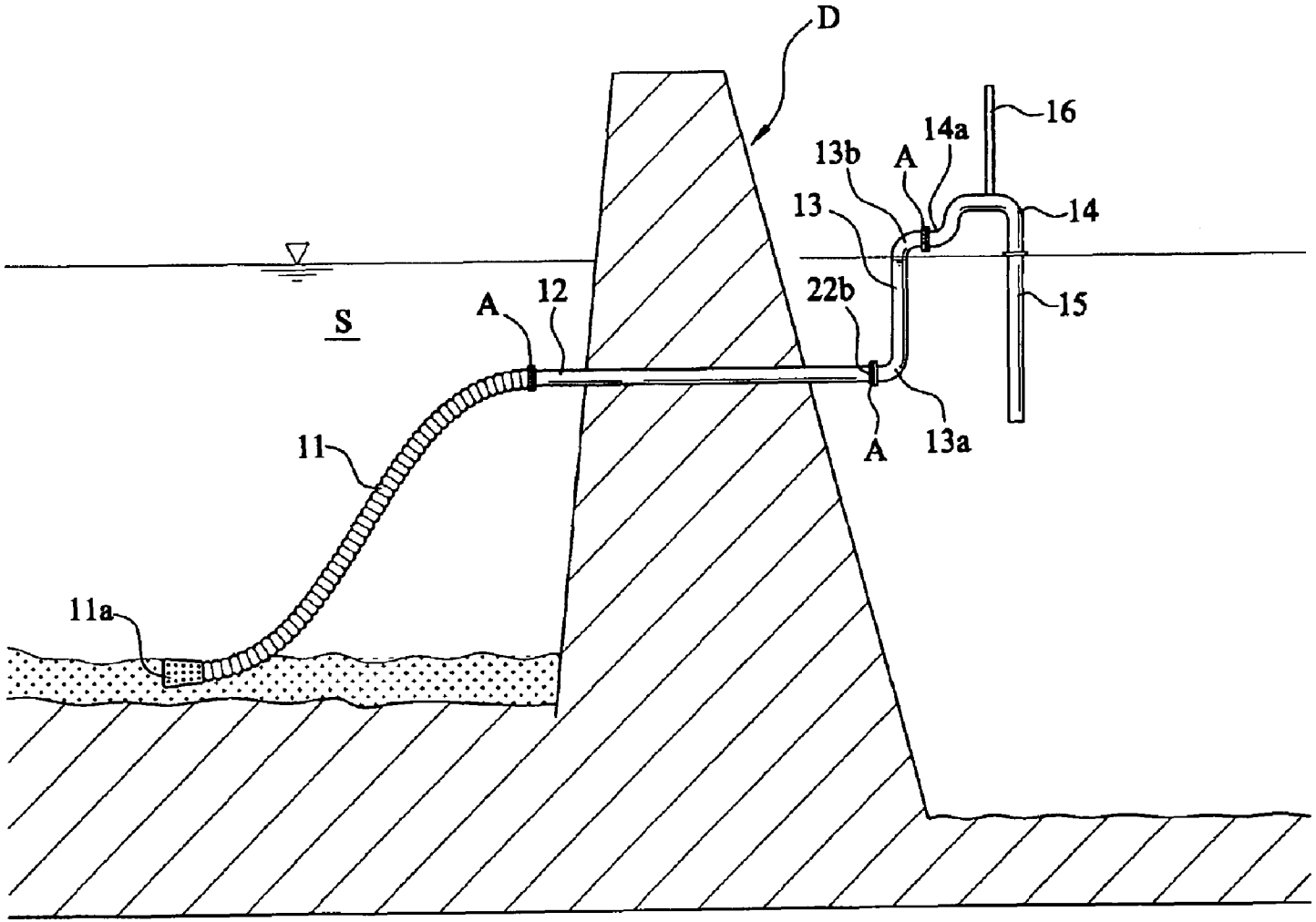

[Fig. 8]
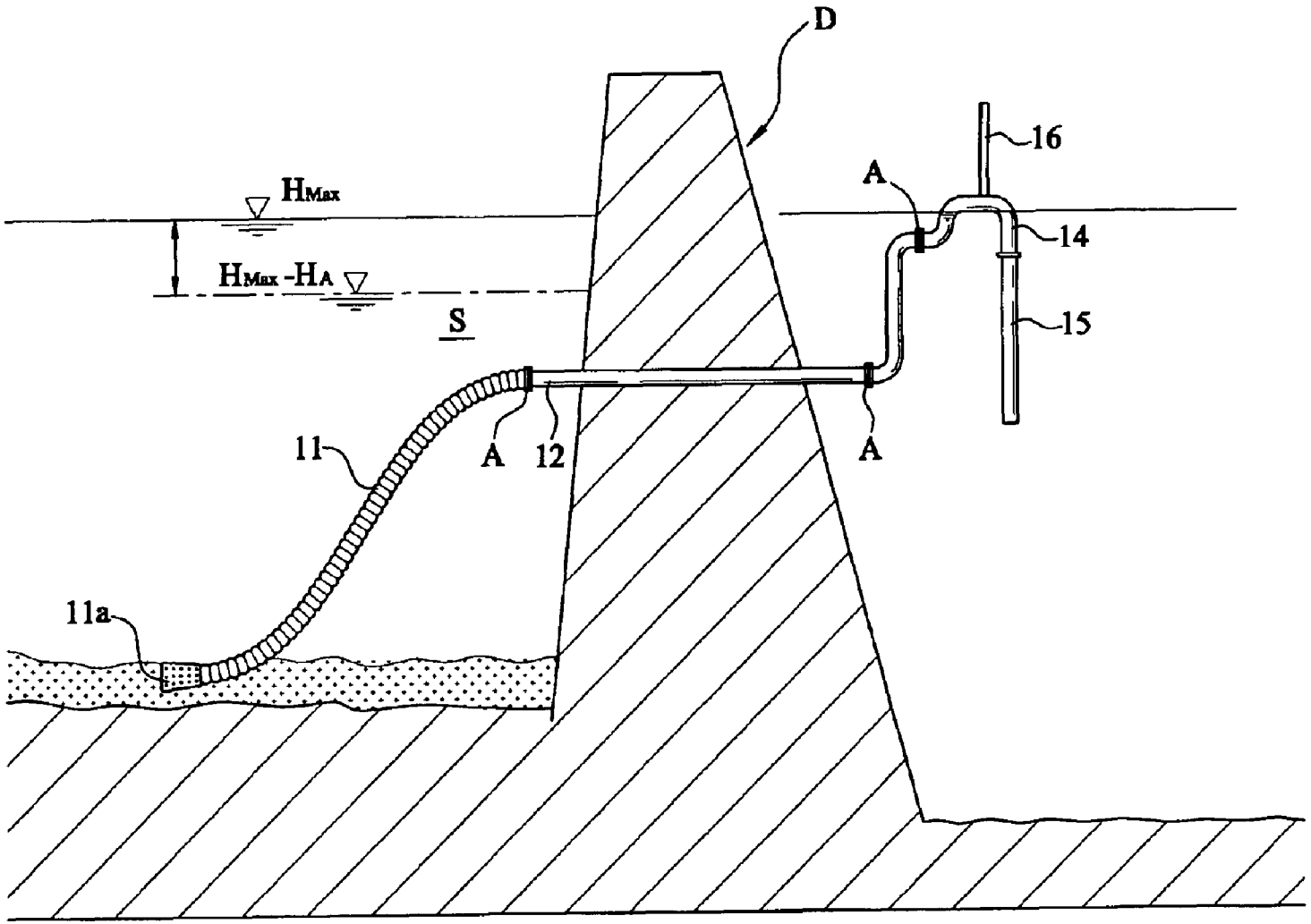

[Fig. 9]
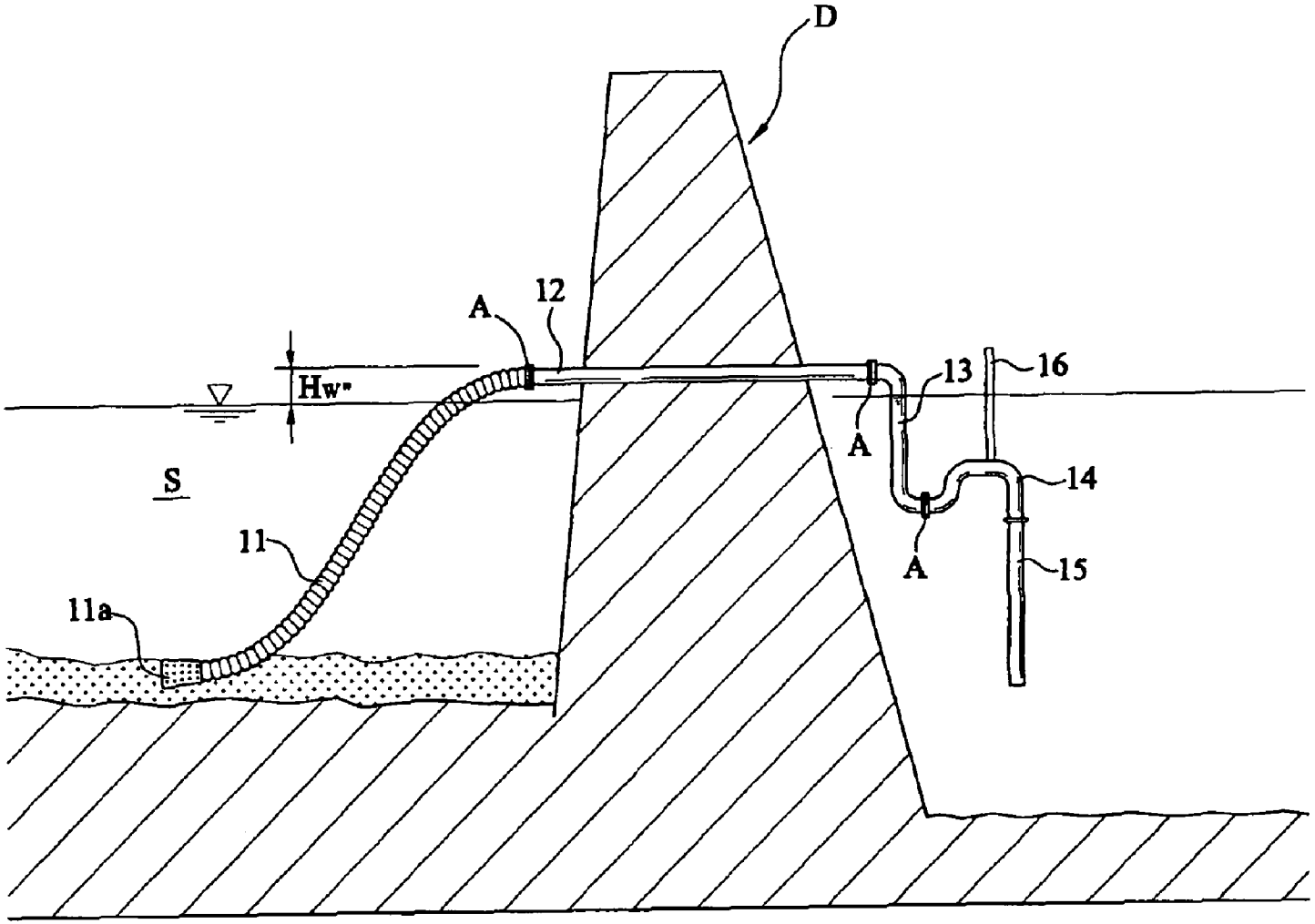

[Fig. 10]
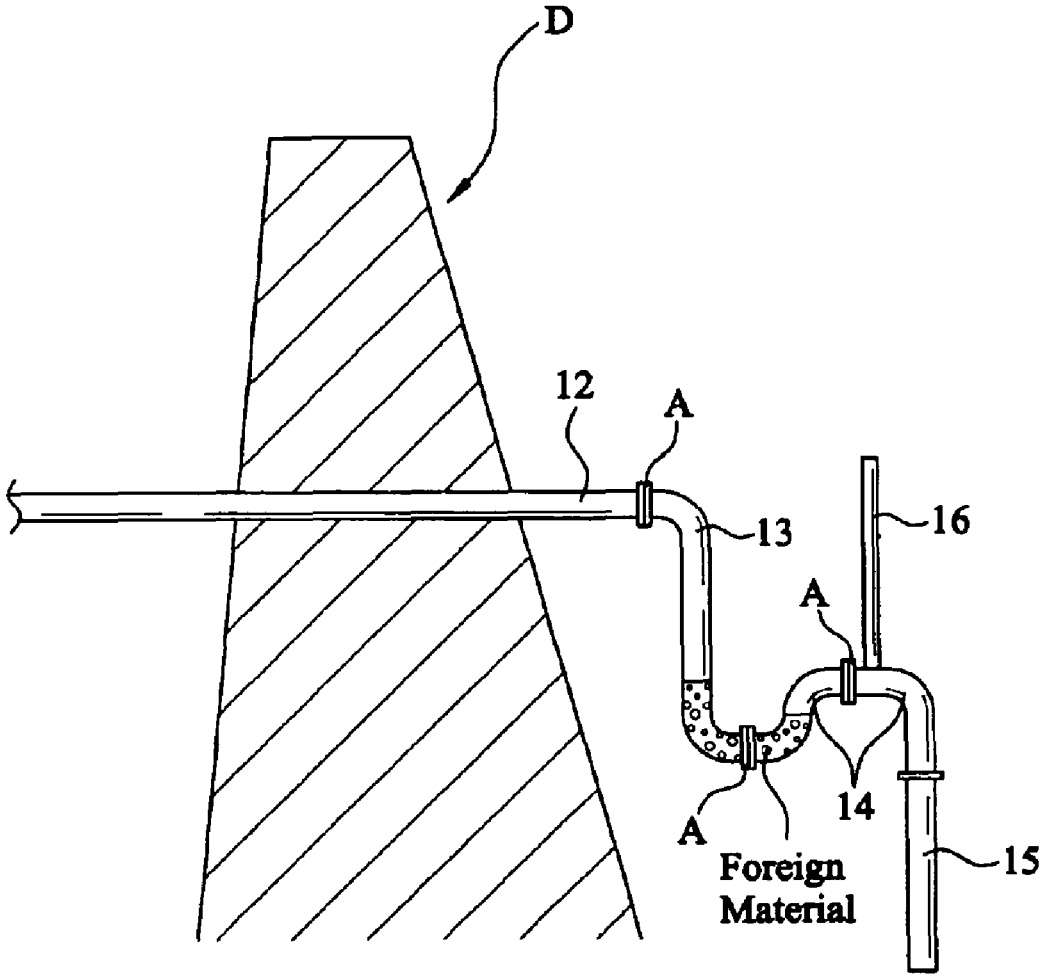

[Fig. 11]
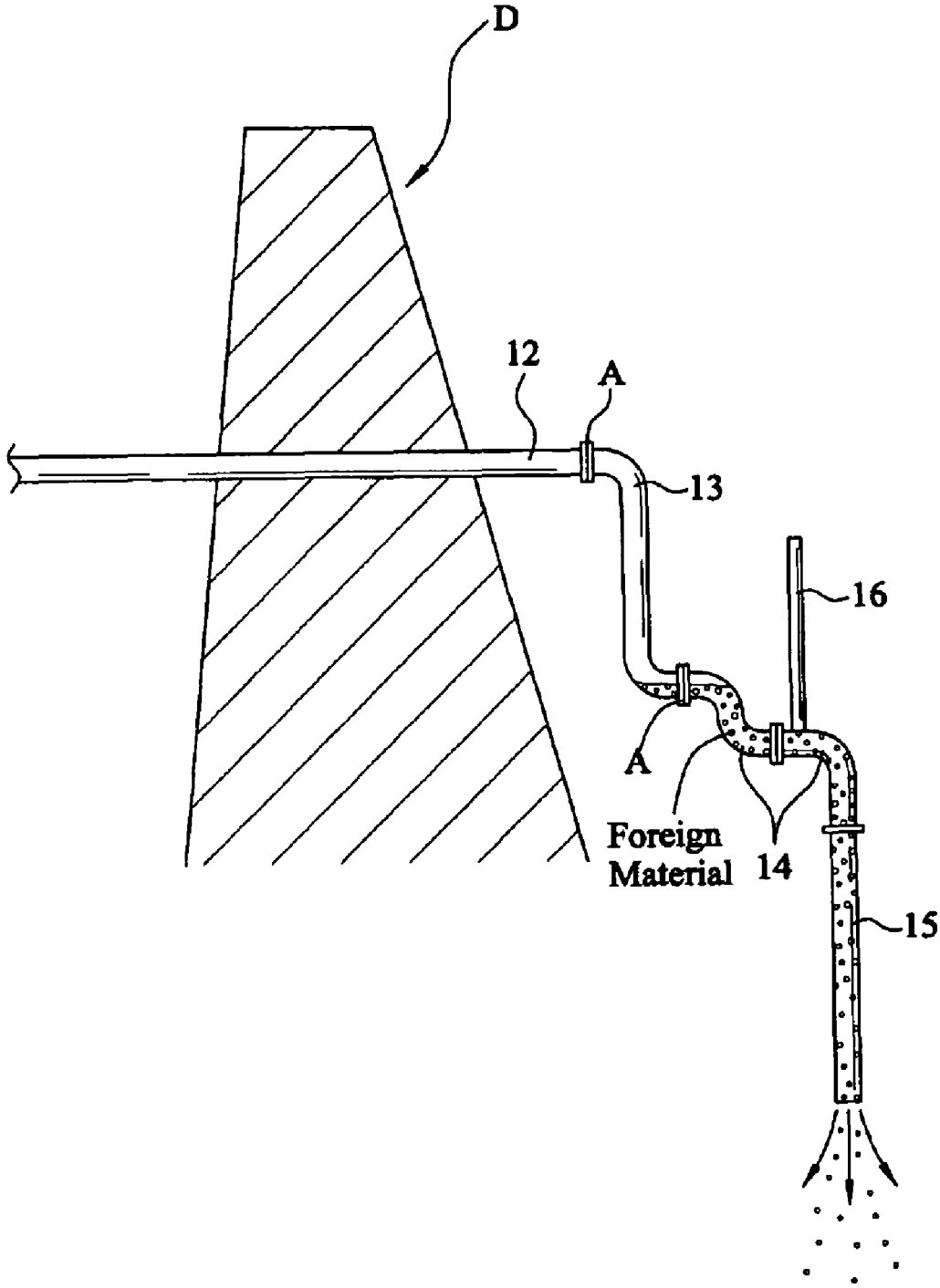

SLUDGE TREATMENT SYSTEM FOR DAM

TECHNICAL FIELD

The present invention is related to a sludge treatment system for dam to strip a reservoir, or a lake of sludge deposited in the water reservoir, and more particularly, to a sludge treatment system for dam, by which potential energy of water contained with a dam of which the height is relatively higher than that downstream is changed into kinetic energy, and a sludge discharge channel being controlled using atmospheric pressure is provided to selectively discharge sludge deposited on the floor of a body of water into the downstream without power consumption, furthermore, an inlet for sludge collection can be moved to a target spot e.g. sludge near the water level if needed, and the clean water can be drained selectively.

BACKGROUND ART

In general, dirty water, sewage, factory wastes, agriculture and stockbreeding wastes flow continually into a dam, lakes or marshes. In these water reservoirs, water flow is almost in a stable state so that sludge settles on its floor. Thus, density of a pollutant in water increases.

Especially, nutrient salts including nitrogenous compound, phosphate in a pollutant helps the germ that breaks down an organic matter breed and proliferate. There is eutrophication in fresh water.

As it is well known, eutrophication is the process by which a body of water becomes enriched in dissolved nutrients (as phosphates) that stimulate the growth of aquatic plant life usually resulting in the depletion of dissolved oxygen.

Due to eutrophication, turbidity of fresh water drops, a bad smell is made by decomposing matter, at worst a group of fish is perished, which brings serious damage—such as ecosystem destruction—to an ecosystem.

It is important to maintain that volume of nutrient matter nitrogen or phosphorus etc., contained in an aquatic ecosystem does not exceed self-purifying capability.

Especially, sludge deposited on the floor of a body of water must be cleaned periodically.

Conventionally, various methods have been adapted for removing sludge from lakes or marshes. Typically, one method of them is using a dredging boat loaded with a sludge sucking apparatus. The dredging boat sails on lakes or marshes, and collects sludge deposits on the bottom of a water reservoir by a vacuum absorbing method. This method has the advantage that the boat can approach toward a big pile of sludge and collects large volume of sludge intensively.

In the dredging boat method, there is no interruption to the sludge gathering work in deep water. But, a huge boat is difficult to approach along the border of the water reservoir having shallow depth, and also it has relatively little processing capacity as concerns massive speedy sludge gathering operations, which brings a disadvantage.

Especially, the sludge dredging boat method has a big demerit of economical budget because a special boat must be prepared and enormous cost is needed to operate a boat. Furthermore, since a sludge sucking apparatus is loaded on the hull, the hull is big and heavy. When this dredging boat travels on water, the boat stirs the water and the sludge deposited on the bottom is dispersed, so the water is disturbed. Furthermore, there is the possibility of an oil spill from the operations apparatus, which require a countermeasure of a secondary pollution problem.

Conventionally, new technologies have been developed to consider the above problems of a dredging boat. The new technologies are a sludge treatment technology using a siphon principle with no power, which are disclosed in Korean Patent Laid-open Nos. 1993-0006262, 1999-014433, 1999-0064630 and 2002-0029287.

In prior arts, an inlet of a siphon is placed at the bottom of a water reservoir, the middle portion of the siphon climbs above the dam, and an outlet of siphon is located at the discharge area of the downstream. A siphon operation is executed at the siphon. Therefore, sludge deposited on the bottom of the water reservoir can be discharged to a discharge area downstream.

In this case, a pump can be run only at the first operation stage, to execute siphon operation. Little power might be consumed. Thus, it may seem that this method is a very economical operation compared to a sludge dredging boat method.

However, in these prior arts that remove sludge from a dam using a siphon principle, air flows into the water channel at s tart-up, and it is difficult to maintain the siphon action for a predetermined time, so that it has frequent stop of operation. When an inlet of a water channel is blocked, work must be stopped regularly to clean it up. The operation is delayed, and a lot of manpower and pump operating time are required to reactivate the siphon action, which bring low efficiency and operation time issues.

Furthermore, large volumes of water along with sludge deposit are sucked up into a water channel by a siphon action, and a follow-up process for separating water from the sludge deposits require much working time. Thus, it has a problem of increase cost for the separating process.

Especially, since a siphon climbs above a dam to perform a water discharge, the siphon operation is impossible if the height difference between the water upper level of water reservoir and the top of the dam is above an atmospheric pressure water head (about 10.33 m).

At a place such as a water reservoir or a dam, where larger volumes of water are dealt, there is such case that the height difference is above 10 m. Therefore, sludge deposit cannot be sucked up strongly by technology using only the siphon principle, which is not adapted to reality.

The Korean Patent No. 093115 in a title of an apparatus for maintaining the constant water level had been registered with the Korean Patent Office by this applicant, in which the water in a reservoir can be kept always at a predetermined water level.

The registered patent is focused on a water reservoir in which liquid contained in the reservoir can be transferred to another liquid reservoir automatically. A U shape pipe and a reverse U shape pipe are sequentially connected to a siphon pipe, and an air vent pipe is provided at the top flat portion of the reverse U shape pipe. One end of the siphon pipe is immersed in water in the water reservoir, and another end of the siphon pipe is connected to the one end of the U shape pipe. Open end of the U shape is connected to the one end of the reverse U shape pipe. In the reverse U shape pipe, the top flat portion must be maintained at the same height as a target water level of the water reservoir.

Under the condition of the full water in the siphon pipe, as a water level in the water reservoir rises above the target water level, the water in the reservoir is discharged automatically. When the water level in the water reservoir lowers to the target water level, the siphon operation stops automatically. In the case that the water in the siphon pipe still remains in the siphon pipe, water is supplied into the reservoir again, and the water level in the water reservoir rises above the target water level and further above the height of top flat portion of the reverse U shape pipe. Thereafter, the siphon operation recurs to discharge the water in the reservoir. Thus, the water level in a water reservoir can be always maintained at the target water level.

The reason of the stoppage of siphon operation is based on that atmospheric air can flow into the reverse U shape pipe through the air vent pipe, and no more siphon operations are performed in the reverse U shape pipe. Conversely, the reason for the automatic recur of the siphon operation is based on that the water in the siphon pipe still stays in the siphon pipe.

In the above mentioned patent, upon starting the siphon operation, without providing power and an additional operation, sequential operations—comprised of discharging water in reservoir, drop water level in reservoir, water standby in siphon pipe, water inflow in reservoir, rise of water level in reservoir, and siphon operation—can be repeated. The water in the reservoir can be always maintained at a constant water level.

However, since this patent is focused on a small volume reservoir and a siphon pipe must climb above the wall, it is impossible to strongly suck up water from a large volume reservoir, same with conventional patents in that sludge in a lake is discharged using conventional siphon usage. Because the difference between the water level in the reservoir and the top level of the wall might exceed atmospheric pressure water head (about 10 m) in most large volume reservoir.

Furthermore, it is no problem that clean water in small volume reservoir can be discharged without blocking the water channel. If this method is applied to the case that water having much sludge will be discharged from a lake, the sludge may be settled down in the U shape pipe to block the pipe. In the conventional patent, since the pipe joint at which a U shape pipe meets with a reverse U shape pipe can not be rotated, it brings difficulty for cleaning the pipe.

Furthermore, since the conventional patent easily discharges water automatically, but there is no additional apparatus for changing water level and controlling the discharging speed, it is difficult that no active measurement can be performed according to water level change and deposit condition.

Therefore, the conventional patent has utility in that water that comes from small volume reservoir can be automatically discharged so as to maintain a predetermined water level. However, if the conventional patent should be adapted to the discharge of lake sludge, no actual effect comes across to consider with a high dam in a lake, deep water levels and sludge discharge.

DISCLOSURE OF INVENTION

Technical Problem

Accordingly, the present invention has been made keeping in mind the above problems occurring in the prior art.

It is an object of the present invention to provide a sludge treatment system for dam to solve various problems being exposed in the prior art, in which large volumes of water are contained in a dam, lakes or marshes, and sludge treatment should be performed.

It is an object of the present invention to provide a sludge treatment system for dam, by which potential energy of water contained in a dam of which the height is relatively higher than that of the downstream is changed to kinetic energy, and a sludge discharge channel being controlled using atmospheric pressure is provided to selectively discharge sludge deposited on the floor of a body of water into the downstream without power consumption, furthermore, an inlet for sludge collection can be moved to a target spot e.g. sludge near a water level if needed, and a clean water can be drained separately.

It is an object of the present invention to provide a sludge treatment system for dam, in which a configuration and the height of the sludge discharge channel can be easily changed, and a pump being operated at lower water level is provided to actively deal with a change of water level and a deposit condition and to control the speed of flow and volume of discharge water, furthermore, cleaning of the pipe can be easily performed.

In order to accomplish those and these objects, it has characteristic in that the present invention is comprised of sludge treatment system for a dam that is comprised of a dam passage penetrated through a dam; an induction pipe for discharging a sediment on a floor of a body of water retained by the dam through the dam passage to the outside of the dam and having an inlet extended toward the floor of the dam and an outlet connected to an inner end of the dam passage; an induction force action pipe connected to an outer end of the dam passage and extended in a height for utilizing an atmospheric pressure as an induction force of the sediment; an air control pipe connected to the extended end of the induction force action pipe in an inverse U shape, and preventing for an air from coming into the induction force action pipe; a drain pipe connected to an open end of the air control pipe for discharging the sediment toward an outside of the dam; and an air vent pipe connected to a top flat portion of the air control pipe for dissipating the induction action of both the air control pipe and the drain pipe.

Furthermore, it has another characteristic in that a vacuum pump is provided at the air control pipe via a connect pipe, and the vacuum pump is operated when a level of water retained by the dam is lower than the level of the dam passage, and further a check valve is provided at the connect pipe, which is opened at the operation of the vacuum pump.

Furthermore, it has another characteristic in that the inlet of the induction pipe has a series of holes, so that it limits the size of the sediment particle allowed to enter.

Furthermore, it has another characteristic in that the inlet of the induction pipe has a camera for monitoring the status and movement of the inlet.

Furthermore, it has another characteristic in that the inlet of the induction pipe is connected to a controllable cable extended from a float on the body of water, and the float is connected to a towboat being operable by power, so that the inlet can move to a working position.

Furthermore, it has another characteristic in that a pipe joint exists between the induction pipe, the dam passage, the induction force action pipe, and the air control pipe, and each pipe can be revolved the pipe joint, and the air control pipe is comprised of two units that are branched from the top flat of the air control pipe, and the two units are swiveledly connected.

Technical Solution

According to the present invention—a sludge treatment system for a dam, potential energy of water contained in a dam of which the height is relatively higher than that of the downstream is changed to kinetic energy, and using the controlled atmospheric pressure at the outlet, the high discharge speed can be obtained, and furthermore, the sludge deposited on the floor of a body of water is selectively discharge to the downstream without power consumption and can be usefully processed.

ADVANTAGEOUS EFFECTS

Furthermore, in a sludge treatment system for a dam, a dam passage is penetrated through the dam, the induction and the induction force action pipe are connected to the dam passage. An air control pipe is connected to the induction force action pipe, and the air control pipe is configured with U and reverse U shape pipe, the water has filled in one end of the air control pipe, and an air circulates in another end of the air control pipe. An air vent pipe is provided at the top of the air control pipe, so that atmospheric pressure is applied. Filling water continually stays in the pipe comprised of the induction pipe, dam passage and induction force action pipe. The air vent pipe can dissipate the induction force existing in both the air control pipe and the drain pipe. The pressure maintained in the pipe can control the speed of flow and volume of discharge water.

Furthermore, an inlet for sludge collection can be moved to a target location e.g. sludge near a water level if needed, and clean water can be drained separately.

Furthermore, using a swivel pipe, a configuration and the height of the sludge discharge channel can be easily changed, and a pump being operated at lower water level is provided to actively deal with a change of water level and a deposit condition and to control the speed of flow and volume of discharge water, furthermore, cleaning of the pipe can be easily performed.

Using kinetic energy and the atmospheric pressure, a sludge deposited on the floor of a body of water is discharged to the downstream without power consumption. Therefore, the present invention has superior advantages in the high economic feasibility in aspect to operation and maintenance cost as well as installation cost, and also in the easier use.

BRIEF DESCRIPTION OF THE DRAWINGS

The above and other objects, features and other advantages of the present invention will be more clearly understood from the following detailed description taken in conjunction with the accompanying drawings, in which:

FIG. 1 is a sludge treatment system for a dam according to one embodiment of the present invention;

FIG. 2 is a sludge treatment system for a dam according to another embodiment of the present invention;

FIG. 3 is a side elevational sectional view showing the dam passage according to the present invention;

FIG. 4 is a side elevational sectional view showing the dam passage installed at a floor of a dam;

FIG. 5 is a view showing the discharge operation at a normal water level;

FIG. 6 is a view illustrating an example in which water flows up through an air vent pipe having a lower height;

FIG. 7 is a view showing an embodiment in which the discharge operation is stopped;

FIG. 8 is a view showing the water level of the highest level;

FIG. 9 is a view showing the water level at a relatively lower level;

FIG. 10 is a view showing a blocking condition in which foreign material is stacked in the U shape pipe between the induction pipe and the air control pipe; and FIG. 11 is a view showing an open free condition in which foreign material is removed from the U shape pipe.

MODE FOR THE INVENTION

This invention will be described further by the way of exemplary embodiments with reference to the accompanying drawings.

FIGS. 1 and 11 show a sludge treatment system for a dam according to the present invention. An induction pipe 11, a dam passage 12, an induction force action pipe 13, an air control pipe 14 and a drain pipe 15 are sequentially connected, which forms a channel for siphoning the sediment on the floor of a body of water retained by a dam "D" and for discharging the sediment toward the outside of the dam "D". A pipe joint "A" is present at each coupling between the induction pipe 11, the dam passage 12, the induction force action pipe 13 and the air control pipe 14. Each pipe can be rotated by the pipe joint "A". An air vent pipe 16 is connected at the top flat portion of the air control pipe 14 and dissipates the induction action of both the air control pipe 14 and the drain pipe 15.

The dam passage 12 penetrates through the dam "D" halfway up the height of the dam "D" with a predetermined height $H_W$ to the water upper level.

The induction pipe 11 is provided with a flexible bending conduit for moveability. On the inner side of the dam "D" an inlet 11*a* of the induction pipe 11 is extended toward the floor of the body of water of the dam "D", and an outlet 11*c* of the induction pipe 11 is connected to the dam passage 12, by which the sediment on the floor is discharged to the outside of the dam "D" through the dam passage 12. The inlet 11*a* has a series of holes, so that it limits the size of the sediment particles allowed to enter. A camera 11*b* is provided at the perimeter of the inlet 11*a* for monitoring the block status of the inlet 11*a* and providing the convenient movement of the induction pipe 11.

A left end 13*a* of the induction force pipe 13 is connected to the outside end 12*b* of the dam passage 12, and the induction force pipe 13 is extended downwards at an effective height $H_P$ (FIG. 5) which utilizes the atmospheric pressure as the induction force of the sediment. A right end 13*b* of the induction force pipe 13 is extended horizontally.

The air control pipe 14 is configured as an inverse U shape, and one end thereof 14*a* is connected to the right end 13*b* of the induction force pipe 13. The air control pipe 14 is branched into two at the top flat portion of the air control pipe 14, and the pipe joint "A" is provided at the top flat portion so that two branched pipes can be rotated at the pipe joint "A". When air flows into the air control pipe 14, the induction force is dissipated at the air control pipe 14 so that no more air enters into the induction force pipe 13. The distance between the top flat portion of the air control pipe 14 and the dam passage 12 is the effective height $H_P$ (FIG. 5) by which the atmospheric pressure water head $H_A$ can be utilized as an induction force for sediment.

The drain pipe 15 is also provided with a flexible bending conduit for moveability. One end of the drain pipe 15 is connected to the open end of the air control pipe 14 in a vertical manner. Sediment that is being inducted into the air control pipe 14 can finally be discharged through the drain pipe 15.

The air vent pipe 16 is provided at the flat portion of the air control pipe 14 so that the air can be induced into the air control pipe 14. The air vent pipe 16 can dissipate the induction force existing in both the air control pipe 14 and the drain pipe 15. A removable plug 16*a* is provided at the top of the air vent pipe 16.

The plug 16*a* is used for restricting atmospheric pressure of the air control pipe 14. For instance, when the drain pipe 15 requires the induction force or when the water filled in the pipe is back-flowed to the clogged inlet 11*a* of the induction pipe 11 so as to reopen the clogged inlet 11*a*, the plug 16*a* is put into the air vent pipe 16 and the air control pipe 14 is lifted up as per the dotted lines shown in FIG. 1. Thereafter, the plug 16*a* is pulled out so that the atmospheric pressure is applied. As the speed of the backflow in the pipe increases, the cleaning of the inlet 11*a* can be easily accomplished.

The height of the air vent pipe 16 must be established by considering that the water flows through the air control pipe 14 and does not vent through air vent pipe 16.

The air vent pipe 16 acts as an air passage for maintaining the filling water of the induction force action pipe 13. The air vent pipe 16 inducts atmospheric pressure and can control the induction force of the drain pipe 15. When the siphoning action is activated in the induction force action pipe 13, the air vent pipe 16 maintains the siphoning action. Furthermore, when the action stops, it prevents the air from entering through the induction force pipe 13.

In FIG. 2 illustrating other embodiment of the present invention, a vacuum pump 18 is provided at a predetermined area of the dam passage 12 through a connect pipe 17. The vacuum pump 18 can be operated when the water level retained by the dam lowers to the level of the dam passage 12. Whenever the vacuum pump 18 operates, a check valve 19 provided at the connect pipe 17 opens.

The inlet 11*a* of the induction pipe 11 is connected to a float 20 through a cable 21 to control the movement of the inlet 11*a*. The float 20 is connected to a towboat 22 that moves by power. FIG. 2 has further included a configuration in that the inlet 11*a* can be moved to a working location by the cable 21.

Moreover, a sediment treating tank 30 is provided below the drain pipe 15. The sediment treating tank 30 separates the sediment and water. The separated water directs to a hydroelectric power plant 40 which is installed downstream at a predetermined height to generate electricity.

The operation of the sludge treatment system for a dam, provided with the swiveling induction force action pipe according to the present invention will be described herein below.

FIG. 3 shows installation of the dam passage 12 according to the present invention. Drain speed of the dam passage 12 is determined by the height $H_W$ between the dam passage 12 and the water level retained by the dam. That is, the drain speed is $$v=\sqrt{2gH_W},$$

neglecting energy loss generated by friction. Therefore, the larger the height $H_W$ between the dam passage 12 and the water level, the faster the drain speed, whilst the smaller the height $H_W$ between the dam passage 12 and the water level, the slower the drain speed.

In case that the dam passage is installed at the lower part of the dam "D" as shown in FIG. 4, the height $H_W$ between the dam passage 12 and the water level is excessively high, and it leads to difficulty, for calculating the speed. Furthermore, the lower part of the dam "D" is very important in a constructive aspect, and safety decrease, which is undesirable.

FIG. 5 illustrates the drain action of the present invention when the upper level of the water in the dam is in a normal status. It explains that depending on the effective height $H_P$ of the induction force action pipe 13, the discharge speed of the pipe could be varied.

Potential energy which transforms into kinetic energy is the sum of the height $H_W$ and a lower value among either the atmospheric pressure head $H_A$ or the effective height $H_P$ of the induction force action pipe 13.

In other word, when the atmospheric pressure head $H_A$ equals or less than the effective height $H_P$, $H_V$ is the sum of $H_W$ and $H_A$, whilst the atmospheric pressure head $H_A$ is larger than the effective height $H_P$, $H_V$ is the sum of $H_W$ and $H_P$. Wherein, $H_V$ is aquatic pressure water head for inducing the speed of the through-flow water in the pipe.

The effective height $H_P$ of the induction force action pipe 13 is the height in which the atmospheric pressure head $H_A$ is utilized as the induction force. When the effective height $H_P$ is more than 10 m, a drain effect is the same.

The installation height $H_C$ of the air vent pipe 16 requires the height for maintaining the water pressure outside of the dam "D". As shown in FIG. 5, if the installation height $H_C$ is lower, the water can flow up through the air vent pipe 16 by the water pressure outside of the dam "D".

FIG. 7 shows an embodiment illustrating the suspension of the drain action according to the present invention. The swiveling pipe joints "A" are provided between the outside end 12*b* of the dam passage 12 and the left end 13*a* of the induction force action pipe 13 and also between the right end 13*b* of the induction force action pipe 13 and the one end 14*a* of the air control pipe 14, respectively. To perform the suspension of the drain action, both induction force action pipe 13 and the air control pipe 14 shown in FIG. 6 rotate at each pipe joint "A", and two pipes 13, 14 are positioned as shown FIG. 7. A height of the flat portion of the air control pipe 14 is larger than that of the water upper level. Thus, siphon action is suspended, and a drain action is ceased.

FIG. 8 shows that the water is collected at the maximum water level $H_{MAX}$ When the water level is higher than the maximum water level $H_{MAX}$, the water in the Dam is automatically drained. In contrary, when the water level is lower than the maximum water level $H_{MAX}$, the drain is not longer performed. If the air vent pipe 16 does not existed, the drain should be continued by the induction force of the drain pipe 15 until the upper level of the water reaches a certain level $H_{MAX}$-$H_A$. That shows that the air vent pipe 16 is very important element in the present invention.

FIG. 9 shows that water upper level is in a lower value. Even if the water level is lower than a level of the dam passage 12, the drain can be continued in case the water level $H_W$ is within atmospheric pressure water head $H_A$.

FIG. 10 illustrates foreign material is stacked in a U shape pipe between the air control pipe 14 and the air vent pipe 15. In this case, as shown in FIG. 11, the air control pipe 14 is rotated to place at a lower level using the pipe joint "A", by which the foreign material can be eliminated easily.

In above embodiment of the present invention, assuming that the water level $H_W$ is 6 m, the speed of fluid is in the following:

In Bernoulli's law, $$H_v=H_A+H_W=10+6=16\text{ m}$$

$$\tfrac{1}{2}\,mv^2=mgh$$

$$v^2=2gh=2\times9.8\times16=313.6\text{ m}^2/\text{sec}^2$$

Speed of fluid $$v=\sqrt{313.6}\cong17.7\text{ m/sec}$$

Furthermore, assuming that Diameter of pipe D=0.5 m,

Cross-section $A=\pi/4\times0.5^2\approx0.196\ m^2$

In continuity's law:

Volume of flow per hour=density×cross-section of pipe×speed of fluid

Volume of discharging fluid is as follows:

Discharge volume per second: $Q_s=17.7\ m/sec\times0.196\approx3.469\ m^3/sec$

Discharge volume per hour: $Q_h=Q_s\times3{,}600=3.469\times3{,}600\approx12{,}488\ m^3$ Discharge volume per day: $Q_d=Q_h\times24=12{,}488\times24\approx299{,}712\ m^3/day$ Discharge volume per year: $Q_y=Q_d\times365=109{,}394{,}880\approx109{,}400{,}000$ That is, discharge volume per year is approximately 10,000 m×1,000 m×10 m.

As shown in the above calculation, in the present invention, enormous water volume, such as dam's area 10 km×1 km, and water head 10 m, can be drained. That establishes the fact that speed for treating sludge is very outstanding.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

INDUSTRIAL APPLICABILITY

According to the present invention—a sludge treatment system for a dam, potential energy of water contained in a dam of which the height is relatively higher than that of the downstream is changed to kinetic energy, and a sludge discharge channel being controlled using atmospheric pressure is provided to selectively discharge sludge deposited on the floor of a body of water into the downstream without power consumption.

Furthermore, an inlet for sludge collection can be moved to a target location e.g. sludge near a water level if needed, and clean water can be drained separately.

Furthermore, a configuration and the height of the sludge discharge channel can be easily changed, and a pump being operated at lower water level is provided to actively deal with a change of water level and a deposit condition and to control the speed of flow and volume of discharge water, furthermore, cleaning of the pipe can be easily performed.

Using kinetic energy and the atmospheric pressure, a sludge deposited on the floor of a body of water is discharged to the downstream without power consumption. Therefore, the present invention has superior advantages in the high economic feasibility in aspect to operation and maintenance cost as well as installation cost, and also in the easier use.

Further, rapid discharge of the condensed water contained in the water-collecting tank brings the easy exhaustion of all foreign substances such as dust etc. and a reduction of foreign substance residue in the water-collecting tank.

The invention claimed is:

1. A sludge treatment system for dam comprising:

a dam passage penetrated through a dam;

an induction pipe for discharging a sediment on a floor of a body of water retained by the dam through the dam passage to the outside of the dam and having an inlet extended toward the floor of the dam and an outlet connected to an inner end of the dam passage;

an induction force action pipe connected to an outer end of the dam passage and extended in a height for utilizing an atmospheric pressure as an induction force of the sediment;

an air control pipe connected to the extended end of the induction force action pipe in an inverse U shape, and preventing for an air from coming into the induction force action pipe;

a drain pipe connected to an open end of the air control pipe for discharging the sediment toward an outside of the dam; and an air vent pipe connected to a top flat portion of the air control pipe for dissipating the induction action of both the air control pipe and the drain pipe, wherein the induction force action pipe is at least partially U-shaped, and wherein a pipe joint exists between the induction pipe, the dam passage, the induction force action pipe, and the air control pipe, and each pipe can be rotated at its pipe joint.

2. A sludge treatment system for dam according to claim 1, wherein a vacuum pump is provided at the air control pipe via a connect pipe, and the vacuum pump is operated when a level of water retained by the dam is lower than the level of the dam passage, and further a check valve is provided at the connect pipe, which is opened at the operation of the vacuum pump.

3. A sludge treatment system for dam according to claim 1, wherein the inlet of the induction pipe has a series of holes, so that it limits the size of the sediment particle allowed to enter.

4. A sludge treatment system for dam according to claim 1, wherein the inlet of the induction pipe has a camera for monitoring the status and movement of the inlet.

5. A sludge treatment system for dam according to claim 1, wherein the inlet of the induction pipe is connected to a controllable cable extended from a float on the body of water, and the float is connected to a towboat being operable by power, so that the inlet can move to a working position.

6. A sludge treatment system for dam according to claim 1, wherein the air control pipe is comprised of two units that are branched from the top flat of the air control pipe, and the two units are swiveledly connected.

7. A sludge treatment system for dam according to claim 1, wherein the air vent pipe has a plug at a free open end.

8. A sludge treatment system for dam according to claim 1, wherein a sediment treating tank is further provided under the drain pipe to separate a sediment and water.

9. A sludge treatment system for dam according to claim 1, wherein the distance between the top flat portion of the air control pipe and the dam passage is the effective height by which the atmospheric pressure water head can be utilized as an induction force for sediment.

* * * * *